US006981530B2

(12) United States Patent
Amano et al.

(10) Patent No.: US 6,981,530 B2
(45) Date of Patent: Jan. 3, 2006

(54) TONER FILLING DEVICE AND TONER PRODUCTION MANAGEMENT SYSTEM

(75) Inventors: Hirosato Amano, Shizuoka (JP); Tetsuo Noji, Shizuoka (JP); Hidenori Minowa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/063,831

(22) Filed: Feb. 23, 2005

(65) Prior Publication Data

US 2005/0139284 A1 Jun. 30, 2005

Related U.S. Application Data

(62) Division of application No. 10/608,366, filed on Jun. 30, 2003, now Pat. No. 6,874,546.

(30) Foreign Application Priority Data

Jul. 5, 2002 (JP) ..... 2002-197223
May 22, 2003 (JP) ..... 2003-145409

(51) Int. Cl.
*B65B 1/30* (2006.01)

(52) U.S. Cl. ..... 141/83; 141/67; 141/94; 141/192

(58) Field of Classification Search ..... 141/18, 141/67, 83, 94, 192, 196; 399/24–27, 258, 399/359

See application file for complete search history.

(56) References Cited

U.S. PATENT DOCUMENTS

| | | | | |
|---|---|---|---|---|
| 3,189,061 | A | 6/1965 | Stockel et al. | |
| 3,261,379 | A | 7/1966 | Stockel et al. | |
| 5,727,607 | A * | 3/1998 | Ichikawa et al. | 141/67 |
| 5,987,298 | A | 11/1999 | Muramatsu et al. | |
| 6,024,141 | A | 2/2000 | Wegman | |
| 6,112,046 | A | 8/2000 | Suzuki et al. | |
| 6,594,451 | B2 | 7/2003 | Kakeshita et al. | |
| 6,874,546 | B2 * | 4/2005 | Amano et al. | 141/83 |

FOREIGN PATENT DOCUMENTS

| | | |
|---|---|---|
| EP | 1 334 906 | 8/2003 |
| GB | 1 459 394 | 12/1976 |
| JP | 2003-104301 | 4/2003 |

OTHER PUBLICATIONS

U.S. Appl. No. 11/063,831, filed Feb. 23, 2005, Amano et al.
U.S. Appl. No. 11/066,267, filed Feb. 28, 2005, Amano et al.

* cited by examiner

*Primary Examiner*—Timothy L. Maust
(74) *Attorney, Agent, or Firm*—Oblon, Spivak, McClelland, Maier & Neustadt, P.C.

(57) ABSTRACT

There is provided a toner container filling device and a toner production management system. The toner container filling device is installed at a toner container filling base and is able to fill a toner container with toner automatically, and obtain information about the toner container filling process while filling the toner container with toner. The toner production management system receives the information from the toner container filling device, and determines the amount of toner to be produced at a toner production base and time of delivering toner to the toner container filling base according to the received information.

5 Claims, 11 Drawing Sheets

FIG.9

FILLER NO. XXXXXX

| D/M/Y | BOTTLE ID | STARTING TIME | STARTING WEIGHT | ENDING TIME | ENDING WEIGHT | FILLING TIME | WEIGHT OF PUMPED TONER | TEMPERATURE | PRESSURE |
|---|---|---|---|---|---|---|---|---|---|
| | XXXXXXXX | XXXXXX | XXXXXX | XXXXXX | XXXXXX | XXXX | XXXX | XXX | XXXX |

FIG.10

| D/M/Y | FILLING BASE NO. | TOTAL NUMBER OF FILLERS | NUMBER OF FILLERS IN OPERATION | FILLER NO.1 (1) | | | FILLER NO.1 (2) | | | SUM | | | FILLER IN TROUBLE |
|---|---|---|---|---|---|---|---|---|---|---|---|---|---|
| | | | | NUMBER OF BOTTLES | SUM OF PUMPED TONER | SUM OF PUMPED TONER | NUMBER OF BOTTLES | SUM OF FILLING TIME | SUM OF FILLING TIME | NUMBER OF BOTTLES | SUM OF PUMPED TONER | SUM OF FILLING TIME | |
| | xxxxxxxx | xxx | xxx | xxxx | xxxxxx | xxxxxx | xxxx | xxxxxx | xxxxxx | xxxxx | xxxxxxx | xxxxxxx | x,x |

TONER FILLING DEVICE AND TONER PRODUCTION MANAGEMENT SYSTEM

This is a divisional application of U.S. patent application Ser. No. 10/608,366, filed on Jun. 30, 2003, now U.S. Pat. No. 6,874,546.

BACKGROUND OF THE INVENTION

1. Field of the Invention

The present invention relates to a toner container filling device for pumping toner into a container (referred to as "toner bottle" hereinafter) and acquiring information of the pumped toner at the same time, and a toner production management system provided between a toner production base and a toner container filling base for accepting the information of the pumped toner acquired by the toner container filling device at the toner container filling base via a network and controlling toner production at the toner production base and toner delivery from the toner production base to the toner container filling base.

2. Description of the Related Art

In electrophotographic color image forming apparatuses, such as copiers or printers, a latent image is formed on a photoconductor, and a developing agent called toner is used to develop the latent image into a visible image (toner image); the toner image is transferred to and fused on paper, and finally, an image is formed on the paper.

In such an electrophotographic color image forming apparatus, the toner is contained in a developer that is arranged close to the photoconductor. In the developer, the toner is mixed with specified carriers and the mixture is agitated to charge the toner. The charged toner is transferred to the photoconductor by applying a bias voltage between the developer and the photoconductor, and is accreted on the latent image, thus forming the toner image.

The toner in the developer is consumed along with formation of images on the paper. When the toner is running out, the density of the image formed on the paper decreases, and the image becomes faint and patchy. So it is necessary to supplement the developer with toner. The supplementing of the developer with toner is accomplished by replacing the toner bottle in use with a new toner bottle filled with toner.

Toner is pumped into the toner bottle at toner production bases where manufacturing facilities are installed to produce toner from raw materials. Toner bottles filled with toner are packaged at the production bases, and shipped to shops, and then are distributed to users of image forming apparatuses from the shops.

Usually, a company has a few toner production bases and a relatively large number of shops and users. Usually the toner production bases are located remote from the shops and users. Therefore, when toner is running out, users have to order new toner bottles filled with toner from shops. If toner bottles are out of stock in shops, the shops have to request the toner production bases to deliver new toner bottles. Delivery of toner bottles from toner production bases to shops may take a long time, and users may not be able to use their copiers or printers until the new toner bottles arrive.

In recent years and continuing, along with the rising demand for environmental protection, re-use of toner bottles is being required. When re-using toner bottles, empty toner bottles are transported from users to toner production bases, and re-filled with toner at the toner production bases. However, if the toner production bases are remote from the shops or users, the cost of this process may be excessive.

One way of solving this problem is to provide toner container filling equipment comprising toner containers of large capacities at shops or other places near the users to re-fill the empty toner bottles with toner. This is the so-called "toner container filling base". By doing this, empty toner bottles may be filled with toner at the toner container filling bases when toner bottles are out of stock at shops. Toner may be transported from the toner production bases regularly to fill the toner containers of large capacities.

For example, Japanese Unexamined Patent Publication No. 2003-104301 discloses a method for installing at a shop a compact and inexpensive toner container filling device, which is easy to handle and equipped with a toner container of a large capacity, and able to manage the amount of the pumped toner by a computer while the toner container filling device is re-filling an empty toner bottle.

This method makes it possible to re-fill the used toner bottles collected from users at places much closer to the users than the toner production bases, and eliminate the necessity of transporting the empty toner bottles from the shops to the toner production bases and transporting the refilled toner bottles from the toner production bases to the users, and therefore reduce the time and costs of transportation of the empty toner bottles and re-filled toner bottles, and significantly reduce the cost of re-use of the toner bottles. Further, this method makes it possible to produce toner by the exactly required amount.

However, when one toner production base produces toner for many toner container filling bases, which are scattered over a vast area, it is essential to make the toner container filling process at all toner container filling bases efficient, and deliver the desired amount of toner from the toner production base to each toner container filling base at the desired time. To do that, it is necessary to accurately determine the amount of the toner that has been pumped to empty toner bottles frequently or in real time, and according to the obtained result, deliver toner from the toner production base to each toner container filling base before toner at each toner container filling base runs out.

On the other hand, from the view of the toner production base, it is also necessary to determine the amount of toner that has been pumped at each toner container filling base frequently, for example, once a week, or once a month, to ascertain the total amount of toner that has been pumped at all toner container filling bases. The required amount of toner is produced before the amount of toner at the toner production base becomes insufficient.

In other words, it is desired to make the toner container filling process automatic at each toner container filling base, and at the same time collect in real time the information concerning the toner container filling process, for example, the amount of toner that has been pumped at each toner container filling base, and send the information to the toner production base.

SUMMARY OF THE INVENTION

It is a general object of the present invention to solve the above problem of the related art.

A more specific object of the present invention is to provide a toner container filling device able to fill a toner container with toner and at the same time obtain information of the amount of the pumped toner, and a toner production management system that receives the information of the toner pumped at a toner container filling base by the toner container filling device, and determines the amount of toner to be produced at a toner production base and time of delivering toner to the toner container filling base according to the received information.

To attain the above object, according to a first aspect of the present invention, there is provided a toner container filling device for filling a toner container with toner, the toner container, when included in an image forming apparatus, supplying the toner to form an image, the toner container filling device comprising a toner storage section configured to store the toner, the toner storage section having an air feeding entrance for feeding air thereinto, and the air fed thereinto fluidizing a portion of the toner stored therein, a toner container filling section configured to take the fluidized toner in from the toner storage section and pump the toner into the toner container, a measurement unit configured to measure the weight of the toner container and output weight data of the toner container, and a control section configured to calculate the weight of the toner pumped into the toner container using the weight data of the toner container output from the measurement unit, the control section controlling the toner container filling section to start pumping toner to the toner container when the toner container is empty, and stop the toner container filling section from pumping toner to the toner container when the toner container is fully filled with toner.

According to the above aspect of the present invention, because the toner is fluidized in the toner storage section, it is easy to transport the fluidized toner to the toner container filling section and pump the toner into the toner container. In addition, because the measurement unit measures the weight of the toner pumped into the toner container in real time, the control section uses the measured result to start or stop the toner filling process, so that the toner filling process may be controlled automatically.

Preferably, the toner container filling section includes a nozzle at an end thereof for injecting toner into the toner container and a shutter for opening and closing the nozzle, and the control section includes a switch unit configured to open the shutter to start and close the shutter to stop the toner being ejected from the nozzle, and transmits a start signal and a stop signal, respectively.

According to the above aspect of the invention, toner ejection may be started or stopped when necessary, and therefore, the toner container filling process may be automated.

Preferably, the toner storage section is airtight, and a toner transporting pipe is inserted into the toner storage section and is connected to the toner container filling section to transport the fluidized toner from the toner storage section to the toner container filling section.

According to the above aspect of the invention, because the toner storage section is airtight, when air is fed into the toner storage section through the air feeding entrance, it is easy to generate higher pressure in the toner storage section and fluidize the toner in the toner storage section.

Alternatively, the toner storage section and the toner container filling section are formed integrally, the toner storage section has an inclined side surface to cause the fluidized toner to flow into the toner container filling section, and the toner container filling section has an air feeding entrance for feeding air thereinto to fluidize a portion of the toner above the nozzle.

According to the above aspect of the invention, because the toner storage section and the toner container filling section are formed integrally, and the toner storage section has an inclined side surface to cause the fluidized toner to flow into the toner container filling section, the toner transportation distance from the toner storage section to the toner container filling section becomes short, and toner may be transported at lower pressure, and consequently, the device can be made compact, and this reduces the possibility of toner clogging. Furthermore, because the toner is fluidized in both the toner storage section and the toner container filling section, it is possible to easily transport the fluidized toner to the toner container filling section and inject the toner into the toner container.

Preferably, the control section calculates toner container filling time based on the timings of the start signal and the stop signal.

According to the above aspect of the invention, the control section uses multiple kinds of information for controlling the toner container filling process.

To attain the above objects, according to a second aspect of the present invention, there is provided a toner production management system for managing production of toner at a toner production base and delivery of toner from the toner production base to a toner container filling base where toner is pumped into a toner container, the toner production management system comprising a toner container filling device provided at the toner container filling base for filling the toner container with the toner delivered from the toner production base; the toner container filling device, while pumping toner into the toner container, measuring toner container filling data and transmitting the toner filling data, and a server configured to receive the toner container filling data and determine the amount of toner production at the toner production base and the time of toner delivery from the toner production base to the toner container filling base based on the toner filling data.

According to the above aspect of the present invention, since the server receives the toner container filling data from the toner container filling device, such as the amount of the toner filled into the toner container or the amount of the toner pumped into toner containers at a toner container filling base, it is possible to remotely and automatically manage the required production amount of toner and the delivery time.

Preferably, the toner container filling device comprises a toner storage section configured to store toner, a toner container filling section configured to take in toner from the toner storage section and fill toner container with toner, a measurement unit configured to measure the weight of the toner container and output weight data of the toner container, and a control section configured to calculate the weight of the toner pumped into the toner container using the weight data of the toner container output from the measurement unit and transmit the weight of the pumped toner to the server as one element of the toner container filling data, the control section controlling the toner container filling section to start pumping toner to the toner container when the toner container is empty, and stop the toner container filling section from pumping toner to the toner container when the toner container is fully filled with toner.

Furthermore, preferably, the control section includes a switch unit configured to start or stop toner ejection from the toner container filling section and the switch unit transmits a start signal or a stop signal, and the control section calculates a toner container filling time from the timings of the start signal and the stop signal and transmits the toner container filling time to the server as one element of the toner container filling data.

Preferably, the server includes a display unit configured to display the toner container filling data transmitted from the toner container filling device.

According to the above aspect of the invention, since toner container filling information is automatically sent from the control section of the toner container filling device to the server, and displayed on a screen, it becomes possible to easily ascertain the amount of the pumped toner required at the toner container filling base, and determine the amount of toner to be newly produced and the time of delivering toner to the toner container filling base, and to easily draw a toner production plan and a toner delivery plan, and to supply toner without running out of stock.

Preferably, the toner production management system further comprises an image capturing unit configured to capture an image of a condition of the toner container filling device and output video signals of the image to the server.

According to the above aspect of the invention, it is possible to determine which toner container filling devices are at low operation rates, and which toner container filling devices are developing problems from the monitor screen, and to direct that appropriate actions be taken, and this improves the efficiency of toner container filling process.

These and other objects, features, and advantages of the present invention will become more apparent from the following detailed description of preferred embodiments given with reference to the accompanying drawings.

BRIEF DESCRIPTION OF THE DRAWINGS

FIG. 9 is a table showing an example of a data structure of the data received by the server 10 at the toner production base 2 and held in a data base in the toner production management system 1 according to the third embodiment of the present invention;

FIG. 10 is a table showing another example of a data structure of the data received by the server 10 at the toner production base 2 and held in a data base in the toner production management system 1 according to the third embodiment of the present invention;

DESCRIPTION OF THE PREFERRED EMBODIMENTS

Below, preferred embodiments of the present invention will be explained with reference to the accompanying drawings.

First Embodiment

Figure 1:
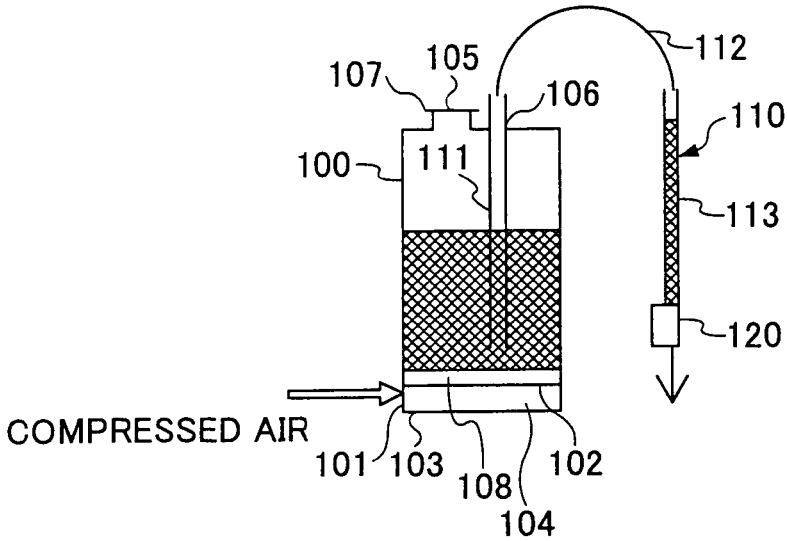
FIG. 1 is a view of a configuration of a toner storage section and a toner filling section of a toner container filling device according to a first embodiment of the present invention.

FIG. 1 shows a toner storage section and a toner container filling section of a toner container filling device 80 according to a first embodiment of the present invention.

The portion of the toner container filling device 80 illustrated in FIG. 1 includes a toner storage section 100 for storing toner, and a toner container filling section 110, and the toner container filling section 110 has a toner output pipe 111 inserted in the toner storage section 100 to pump toner from the toner storage section 100, a flexible toner transporting pipe 112 connected to the toner output pipe 111 to transport the toner pumped through the toner output pipe 111, and a nozzle 113 for ejecting the toner transported from the toner transporting pipe 112. Further, a shutter 120 is provided at the front end of the nozzle 113 to open and close the nozzle 113.

The toner storage section 100 is a circular cylinder. At the bottom of the toner storage section 100, there are an air feeding entrance 101 for feeding compressed air into the toner storage section 100, an air porous plate 102 above the air feeding entrance 101 that blocks toner but passes air or gas through, and an air room 104 between a bottom plate 103 and the air porous plate 102.

At the top of the toner storage section 100, there is a toner feeding entrance 105 for feeding toner into the toner storage section 100, and an insertion entrance 106 for inserting the toner output pipe 111 into the toner storage section 100. The toner feeding entrance 105 is covered and sealed by a lid 107, and the insertion entrance 106 is sealed by welding.

Therefore, the top of the toner storage section 100 is sealed, and from the bottom, compressed air is fed into the toner storage section 100 to apply pressure on the toner therein. The compressed air fed through the air porous plate 102 rises in the toner storage section 100, and blends with the toner composed of fine toner particles, forming a toner fluid bed 108 in a region close to the air porous plate 102. The compressed air further rises and reaches the upper portion of the toner storage section 100 above the stored toner and the upper portion is filled with the air. In this upper portion, the compressed air increases the pressure there and fluidizes the toner close to the toner fluid bed 108.

The toner output pipe 111 inserted into the toner storage section 100 through the insertion entrance 106 is arranged so that one end of the toner output pipe 111 faces the toner fluid bed 108 or the toner layer close to the toner fluid bed 108 to pump toner into the pipe 111 from the toner fluid bed 108 or from the toner layer close to the toner fluid bed 108. Because of the pressure applied by the compressed air at the entrance of the toner output pipe 111 and the difference between the pressure at the entrance of the toner output pipe 111 and the atmospheric pressure at the front end of the nozzle 113, the toner close to the entrance of the toner output pipe 111 is pumped into the toner output pipe 111 and flows to the front end of the nozzle 113 through the toner output pipe 111 and the toner transporting pipe 112, and is ejected out from the front end of the nozzle 113.

Because the toner stored in the toner storage section 100 is fluidized, the self-weights of the toner fine particles do not impose forces on each other. Due to this, the additive agent added to the toner in the toner storage section 100 for preventing separation of toner images is opposed merely by outer forces and is hardly stripped off. Further, compared to the mechanical toner transportation method of the related art, in the toner container filling device 80 shown in FIG. 1, the toner is subject merely to friction forces, and therefore toner can be pumped from the entrance of the toner output pipe 111 to the front end of the nozzle 113 smoothly and efficiently.

Figure 2:
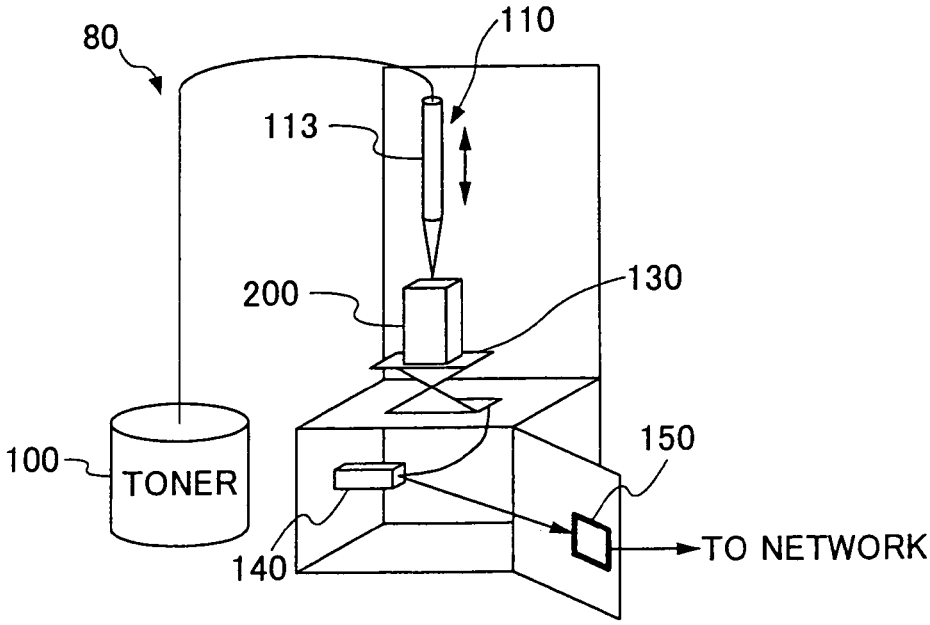
FIG. 2 is a view of a configuration of the toner container filling device according to the first embodiment of the present invention.

FIG. 2 shows a configuration of the toner container filling device 80 according to the first embodiment of the present invention.

The toner container filling device 80 illustrated in FIG. 2 includes a toner storage section 100 for storing a large amount of toner delivered from a toner production base in airtight condition and supplying the toner to fill a toner bottle 200 when necessary, and a toner container filling section 110 for pumping toner from the toner storage section 100 and ejecting the toner from the nozzle 113 and injecting the toner into the toner bottle 200 placed at a specified position, a measurement unit 130 for measuring the weight of the toner bottle 200 in the course of filling the toner bottle and outputting the measured data at each specified timing, a controller 140 for controlling the starting timing and the ending timing of pumping toner from the toner container filling section 110, and a computer 150 for calculating the amount of the toner pumped into the toner bottle 200 and the time period of filling the toner bottle based on the signals output from the measurement unit 130 and the controller 140 and transmitting the calculated amount of the pumped toner and the toner bottle filling time to a network.

For the measurement unit 130, an electronic balance or a road roller may be used.

The computer 150 has a table in which the weight of the toner bottle 200 when fully filled with toner (referred to as "full weight" below) and the weight of the empty toner bottle 200 (referred to as "bottle weight" below) are recorded in advance in correspondence with the type of the toner bottle 200. When pumping toner into an empty toner bottle 200 collected from users at a toner container filling base, for example, an operator inputs the identification number (ID number) of the toner bottle 200 into the computer 150 through an input unit, and the computer 150 reads out the full weight and the bottle weight (recorded in advance) of the toner bottler 200, and sends the weight data to the controller 140.

The controller 140 compares the weight data sent from the computer 150 with the data measured and output by the measurement unit 130, and if the bottle weight data element sent from the computer 150 is not less than that given by the measurement unit 130, the controller 140 concludes that an empty toner bottle 200 has been set at a specified position. Then when the toner container filling section 110 is inserted into the toner bottle 200, the controller 140 sends a signal to the shutter 120 (FIG. 1) at the front end of the nozzle 113 to open the shutter 120 and pump toner into the toner bottle 200.

The measurement unit 130 measures the weight of the toner bottle 200 at certain time intervals while filling the toner bottle 200 with toner, for example, 5 to 7 times per second, and outputs the weight data.

The controller 140 continually compares the data measured and sent by the measurement unit 130 with the full weight data element sent from the computer 150, and when the difference between them becomes zero or sufficiently small, the controller 140 sends a signal to the shutter 120 to close the shutter 120.

The computer 150 calculates the net weight of the toner pumped into the toner bottle 200 using the bottle weight (measured by the measurement unit 130 when the controller 140 finds that the toner bottle 200 has been set at the specified position) and the full weight of the toner bottler 200 (measured by the measurement unit 130 when the controller 140 sends the signal to close the shutter 120).

In addition, the computer 150 calculates the toner container filling time from the timing of the signal output by the controller 140 to start the pumping of toner into the toner bottle 200, and the timing of the signal output by the controller 140 to end the pumping of toner. The computer 150 transmits the obtained net weight of the toner pumped into the toner bottle 200 and the toner container filling time, and other toner container filling information, to the network at specified timings.

As described here, in the toner container filling device 80 shown in FIG. 2, the data output from the measurement unit 130 and the controller 140 are not transmitted to the toner production base directly, but stored in the computer 150 at first, and then transmitted to the toner production base at specified timings.

Figure 3:
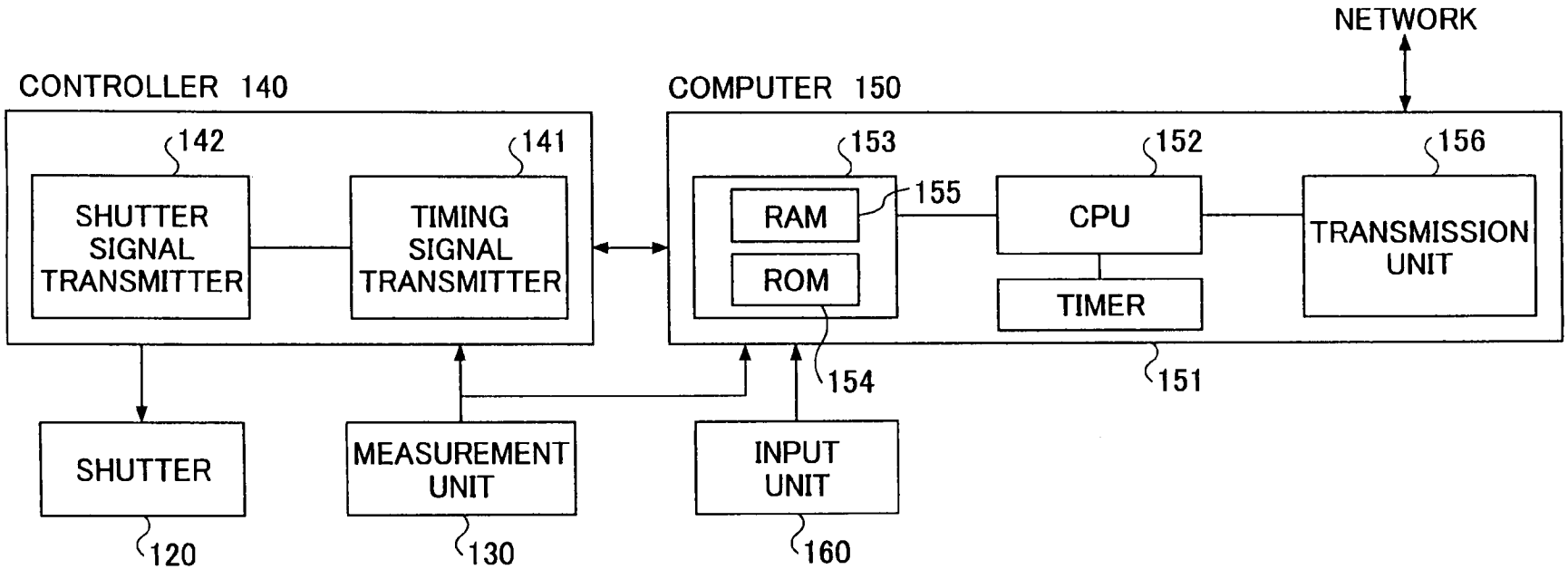
FIG. 3 is a block diagram showing a functional configuration of the toner container filling device according to the first embodiment of the present invention.

FIG. 3 shows a functional block diagram of the toner container filling device 80 in FIG. 2.

As illustrated in FIG. 3, the toner container filling device 80 includes an input unit 160, a computer 150, a controller 140, a measurement unit 130, and a shutter 120. The controller 140, the measurement unit 130, and the input unit 160 are connected to the computer 150, and the controller 140 is connected to the shutter 120 and the measurement unit 130.

The input unit 160, for example, has a keypad, and an operator inputs the identification number (ID number) of the toner bottle 200 that is to be filled with toner into the computer 150 by operating the keypad.

The shutter 120 includes an electromagnetic valve that opens and closes the opening of the nozzle 113 of the toner container filling section 110. When the controller 140 sends out a signal to open the shutter 120, the shutter 120 is opened to start to fill the toner bottle 200 with toner. When the controller 140 sends out a signal to close the shutter 120, the shutter 120 is closed to stop filling the toner bottle 200 with toner.

The measurement unit 130 has a not-shown load cell at the position where the toner bottle 200 is to be set, and a not-shown AD converter to convert the output signals from the load cell into digital signals at certain time intervals. Once the empty toner bottle 200 is set at a specified position, the measurement unit 130 first outputs a digital signal representing the measured bottle weight data, and sequentially outputs signals representing the currently measured weight of the toner bottler 200. Therefore, the value of the signal output from the measurement unit 130 increases gradually along with the toner bottle filling process.

The computer 150 includes a timer 151, a CPU 152, a memory 153, and a transmission unit 156. The memory 153 includes a ROM 154 for storing routines executed by the CPU 152, and a RAM 155 for temporarily storing the digital signals from the measurement unit 130, the timing signals output from a timing signal sender 141, and the temporary data output by the CPU 152 while calculating. In the memory 153 there is stored a table in which the weight of the toner bottle 200 fully filled with toner, that is, the full weight, and the weight of the empty toner bottle 200, that is, the bottle weight, are recorded in advance in correspondence with the type of the toner bottle 200.

The CPU 152 calculates the net weight of the toner pumped into the toner bottle 200 and the toner bottle filling time when the timing signals from the controller 140 and the digital signals from the measurement unit 130 are input to the CPU 152, and further automatically transmits the obtained toner bottle filling information to a network through the transmission unit 156 at each specified timing. In addition to the net weight of the pumped toner and the toner bottle filling time, the toner bottle filling information may also includes the pressure of the compressed air applied at the toner storage section 100, the temperature inside the toner storage section 100, and so on.

According to the above description, when the identification number of the toner bottle 200 is input to the computer 150 and the toner bottle 200 is set at the specified position, the toner container filling device 80 automatically fills the toner bottle 200 with toner until the toner bottle 200 is fully filled. Note that the toner container filling device of the present embodiment is not limited to the above configuration. For example, the toner container filling device may also be configured to control the starting of filling from the input unit 160 by the operator.

Second Embodiment

The toner container filling device 90 of the second embodiment is the same as that of the first embodiment except that the toner storage section and the toner container filling section are different. Therefore, the overlapping explanation is omitted below.

Figure 4:
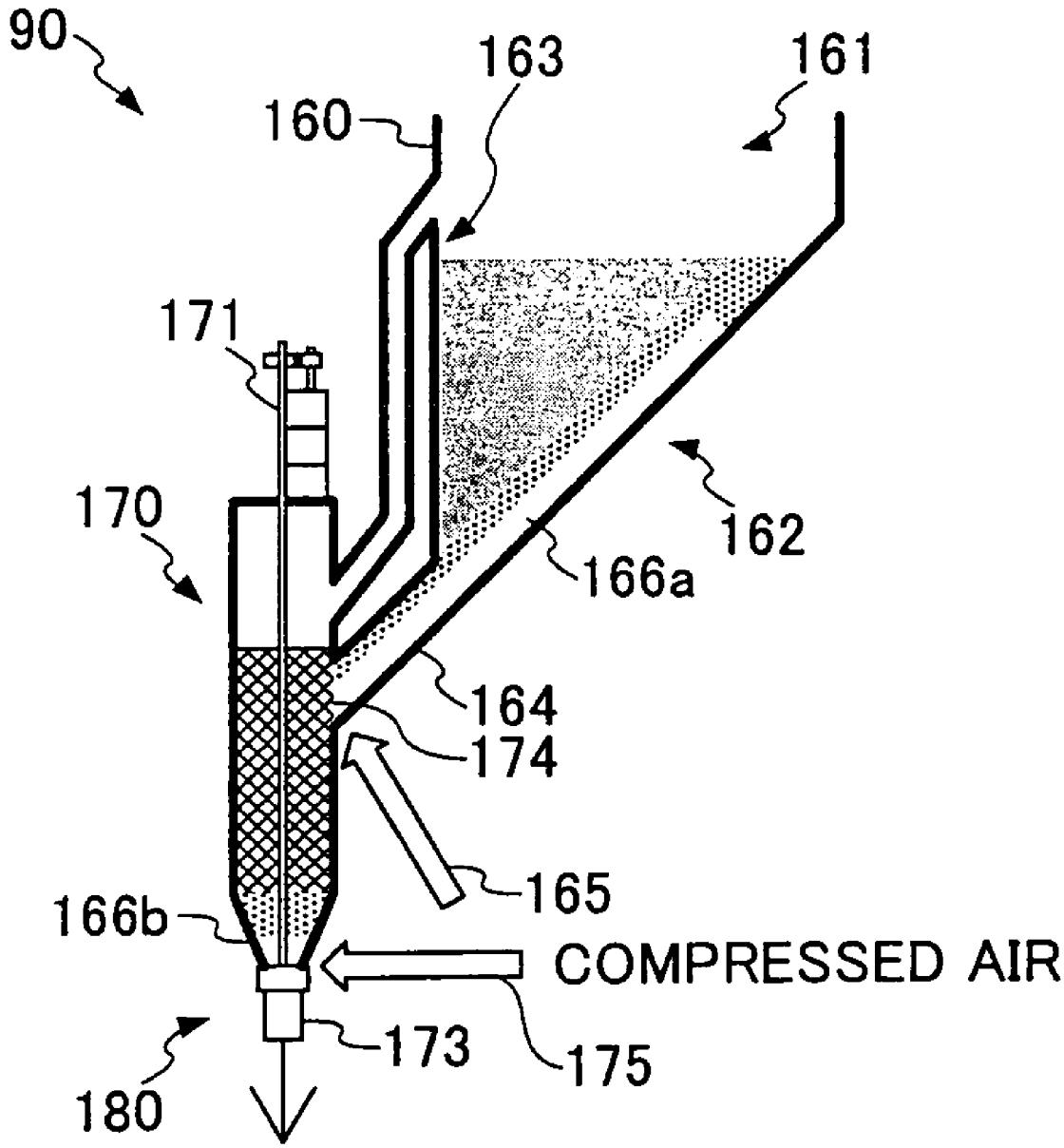
FIG. 4 is a view of a configuration of a toner storage section and a toner container filling section of a toner container filling device according to a second embodiment of the present invention.

FIG. 4 is a view of a configuration of a toner storage section and a toner container filling section of a toner container filling device 90 according to the second embodiment of the present invention.

The toner container filling device 90 illustrated in FIG. 4 includes a toner storage section 160 for storing toner, and a toner container filling section 170, and the toner storage section 160 and the toner container filling section 170 are formed integrally. The toner container filling section 170 has a nozzle 173 for ejecting the toner pumped from the toner storage section 160.

The main body of the toner container filling section 170 is a circular cylinder, and the lower end is a cone serving as the nozzle 173.

A wedge-shaped control rod 171 is inserted into the opening of the nozzle 173 and is fitted to the nozzle 173 so as to keep the control rod 171 movable up and down, forming a shutter 180 to open and close the opening of the nozzle 171.

The control rod 171 of the shutter 180 is driven and controlled by a signal sent from the controller 140.

The toner storage section 160 is funnel-shaped, including a rectangular opening 161 at the top, an inclined side surface 162, a perpendicular side surface 163, and a funnel 164 at the bottom. The lower end of the funnel 164 is welded to the toner filling section 170 at a portion 174 of the side surface.

At the lower end of the funnel 164, there is an opening 165 acting as an entrance for feeding compressed air. When compressed air is fed into the toner storage section 160 through the entrance 165, the region close to the inclined side surface 162 of the toner storage section 160 becomes a toner fluid bed 166*a*.

The toner container filling section 170 of the present embodiment also has an entrance 175 above the nozzle 173 for feeding the compressed air, and when compressed air is fed into toner container filling section 170 through the entrance 175, the region close the end of the nozzle 173 becomes a toner fluid bed 166*b*.

Because of the formation of the fluid bed 166*a* near to the inclined side surface 162 in the toner storage section 160, the toner in the toner storage section 160 floats up, and can be fed to the toner container filling section 170 smoothly. In addition, although this toner fed into the toner container filling section 170 applies pressure to the toner below due to the self-weight of the toner fine particles, since there is formed another fluid bed 166*b* above the nozzle 173, toner can be ejected through the nozzle 173 smoothly.

According to the present embodiment, because the fluid bed 166*a* of the toner storage section 160 is formed near the inclined side surface 162, and the distance for feeding toner from the toner storage section 160 to the toner container filling section 170 is short, it is sufficient to set pressure of the compressed air fed through the entrance 174 lower than that in the first embodiment. Further, because the toner storage section 160 and the toner container filling section 170 are formed integrally, there is no need to use a pipe to transport toner, and therefore, the toner container filling device can be made compact, enabling prevention of toner clogging.

Third Embodiment

The present embodiment relates to a toner production management system.

Figure 5:
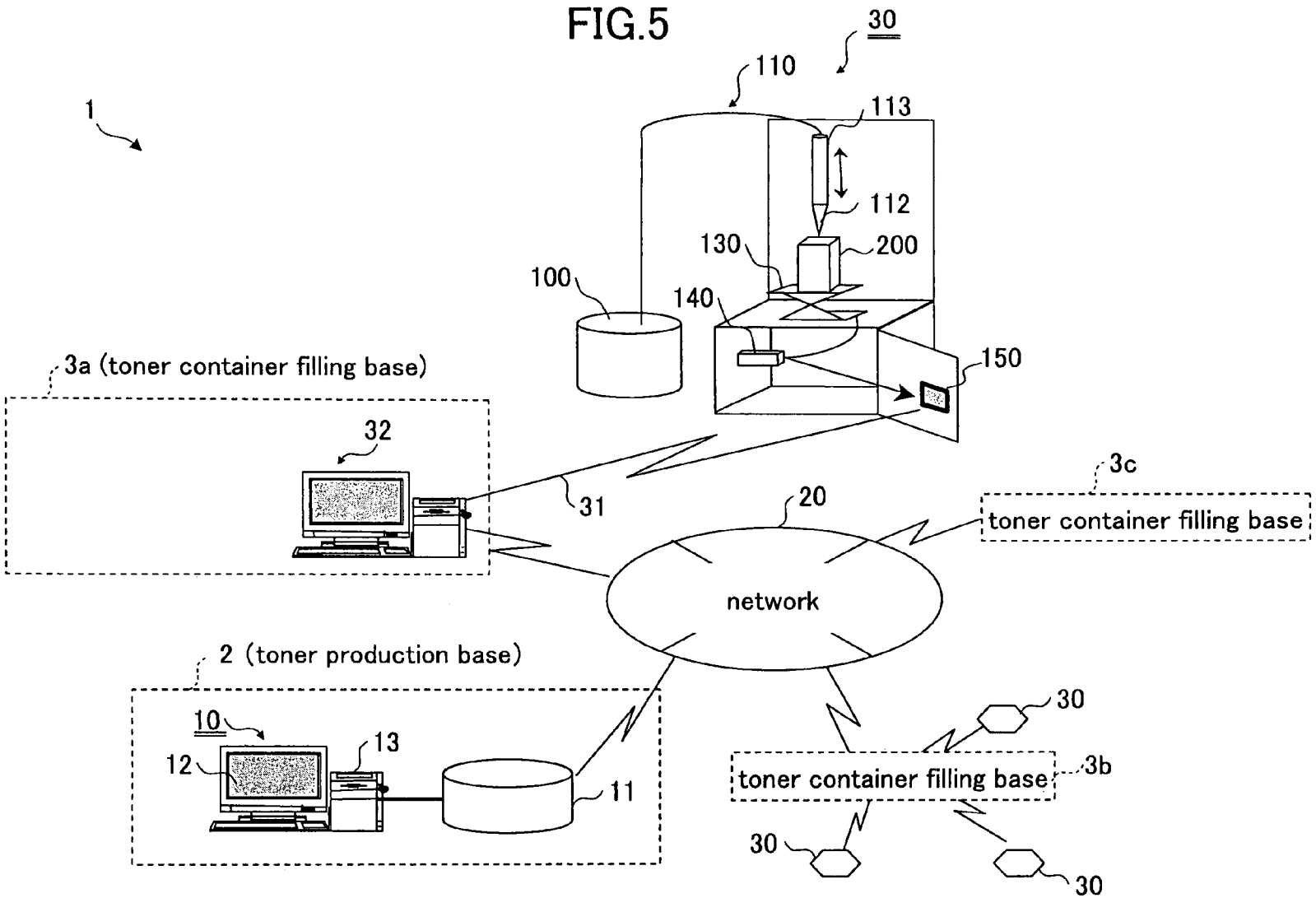
FIG. 5 is a schematic view of a configuration of a toner production management system according to a third embodiment of the present invention.

FIG. 5 is a schematic view of a configuration of a toner production management system 1 according to the third embodiment of the present invention.

The toner production management system 1 illustrated in FIG. 5 includes a server 10 located at a toner production base 2 for producing toner and supplying the toner to toner container filling bases 3*a*, 3*b* and 3*c*, and toner container filling devices 30 located at the toner container filling bases 3 and connected to the server 10 through a network 20. The server 10 is referred to as "toner production server" below.

As shown in FIG. 5, the toner production base 2 may provide toner for one or more toner container filling bases 3, and each of the toner container filling bases 3*a*, 3*b* and 3*c* may be equipped with one or more toner container filling devices 30.

Here, each of the toner container filling devices 30 is the same as that described in the first embodiment (FIGS. 1 through 3), and the overlapping explanations are omitted. Certainly, the toner container filling devices 30 may also be as described in the second embodiment (FIG. 4).

Each of the toner container filling devices 30 includes a toner storage section 100, and a toner container filling section 110 having a shutter 112 for opening and closing a nozzle 113, a measurement unit 130, a controller 140, and a computer 150.

At each of the toner container filling bases 3, for example, the toner container filling base 3*a*, there is a computer functioning as a server 32 (referred to as "toner container filling base server" below). The computer 150 of the toner container filling device 30 is connected to the toner container filling base server 32 through a local area network (LAN) 31. The toner container filling base server 32 collects and stores toner container filling information from the toner container filling devices 30 at the toner container filling base 3*a*, and sends the information to the toner production base 2 through the network 20. The information stored in the toner container filling base server 32 may be used for various purposes, for example, sales management and customer management.

The toner production base 2 includes a storage device 11 (for example, a hard disk), a monitor screen 12, and a work station 13. The work station 13 reads desired data from the hard disk 11, and displays the operating conditions of all the toner container filling devices 30, or displays in real time the change of the quantity of the toner that has been pumped at all the toner container filling bases 3.

Figure 6:
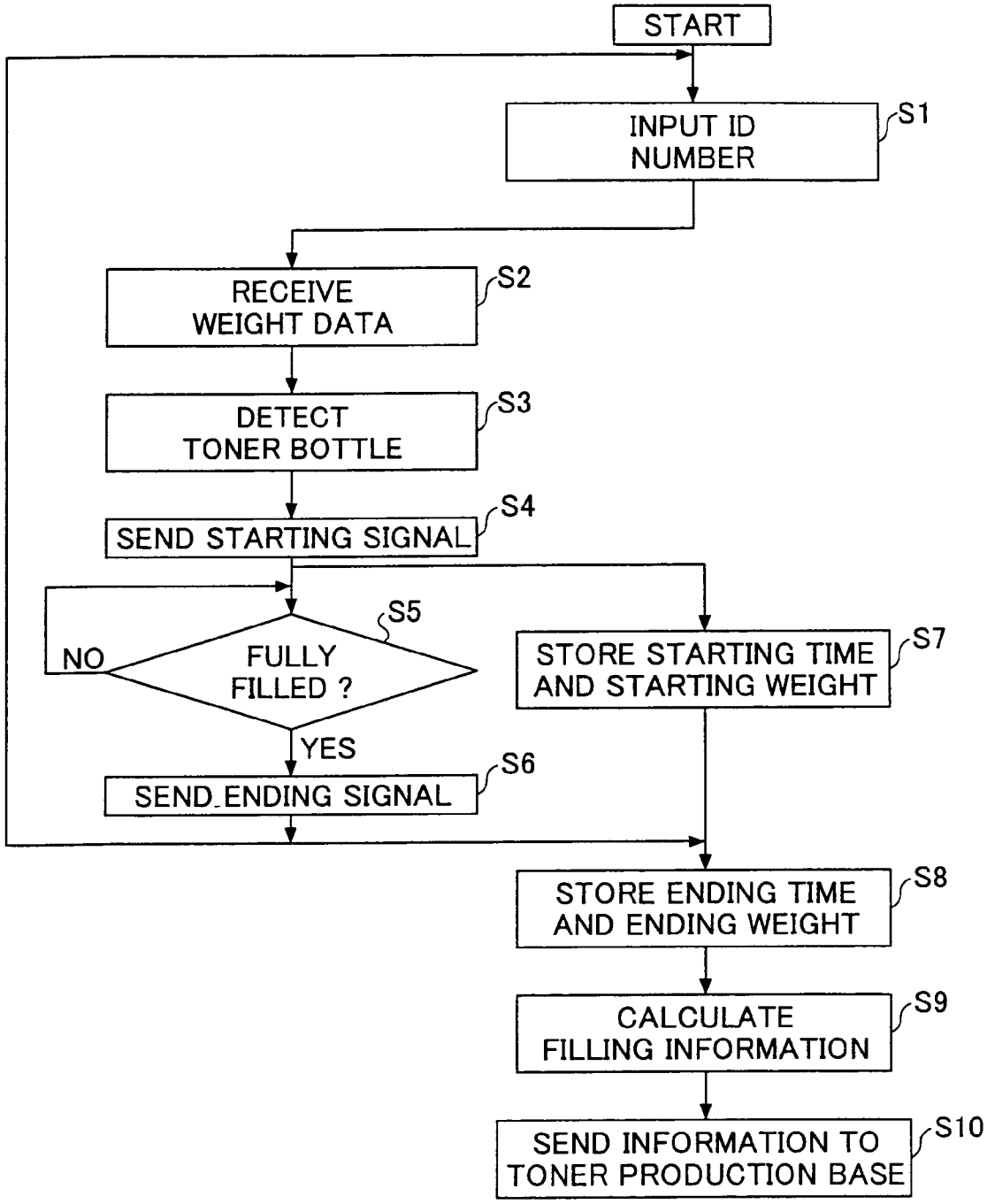
FIG. 6 is a flow chart showing the operation of acquiring toner container filling information of a toner container filling device in the toner production management system according to the third embodiment of the present invention.

FIG. 6 is a flow chart showing the operation of acquiring the toner container filling information of a toner container filling device in the toner production management system 1 according to the third embodiment. Here, it is assumed the toner bottle 200 is to be filled with toner at a toner container filling base 3.

As illustrated in FIG. 6, in step S1, the identification number of the toner bottle 200 is input to the computer 150 through an input unit.

In step S2, the computer 150 sends the bottle weight and the full weight of the toner bottle 200 to the controller 140, and checks the data from the measurement unit 130.

In step S3, the controller 140 compares the weight data sent from the computer 150 with the data measured and output by the measurement unit 130, and if the bottle weight data element sent from the computer 150 is not less than that given by the measurement unit 130, the controller 140 concludes that an empty toner bottle 200 has been set at a specified position.

In step S4, the controller 140 sends a filling starting signal to the shutter 120 and the computer 150 to start pumping toner into the toner bottle 200. Once the shutter 120 receives the filling starting signal, it opens the opening of the nozzle 113 to pump toner into the toner bottle 200.

On one hand, in step S5, the measurement unit 130 measures the weight of the toner bottle 200 at specified time intervals when filling the toner bottle 200, for example, 5 to 7 times per second, and outputs the measured weight data to the controller 140. Receiving the measured weight, the controller 140 continually compares the measured weight with the full weight data to determine whether the measured weight of the toner bottle 200 has reached the full weight. If it has, the routine proceeds to step S6; if it has not, the filling process is continued.

In step S6, since the measured weight of the toner bottle 130 has reached the full weight, that is, the difference between the measured weight and the full weight is zero or sufficiently small, the controller 140 sends a filling ending signal to the shutter 120 and the computer 150 to close the shutter 120.

On the other hand, in step S7, after the computer 150 receives the filling starting signal sent from the controller 140 as described in step S4, the computer 150 stores the toner container filling starting timing and the initial weight of the toner bottle 200 measured by the measurement unit 130 when the toner container filling device 30 starts to fill the toner bottle 200 with toner.

In step S8, after the computer 150 receives the filling ending signal sent from the controller 140 as described in step 6, the computer 150 stores the toner container filling ending timing and the weight of the toner bottle 200 measured by the measurement unit 130 when the toner bottle 200 is fully filled with toner.

In step S9, the computer 150 calculates the toner container filling time from the toner container filling starting timing and the toner container filling ending timing. In addition, the computer 150 calculates the net weight of the toner pumped into the toner bottle 200 from the bottle weight measured by the measurement unit 130 when the toner filling device 30 starts to fill the toner bottler 200 with toner, and the full weight of the toner bottler 200 measured by the measurement unit 130 when the toner bottle 200 is fully filled with toner.

In step S10, the computer 150 transmits the net weight of the toner pumped into the toner bottler 200 and the toner container filling time, and other toner container filling information such as the pressure of the compressed air, and the temperature inside the toner storage section 100, to the toner container filling base server 32 through the LAN at specified timings. The toner container filling base server 32 sends the information sent from a number of toner container filling devices to the toner production base server 10 at the toner production base 2 through the network 20.

Below, a comparison is made between a case in which the toner container filling information is stored in the computer 150 for a while before being transmitted to the toner production base 2, and a case in which the data output from the controller 140 and the measurement unit 130 are transmitted to the toner production base 2 directly.

Figure 7A:
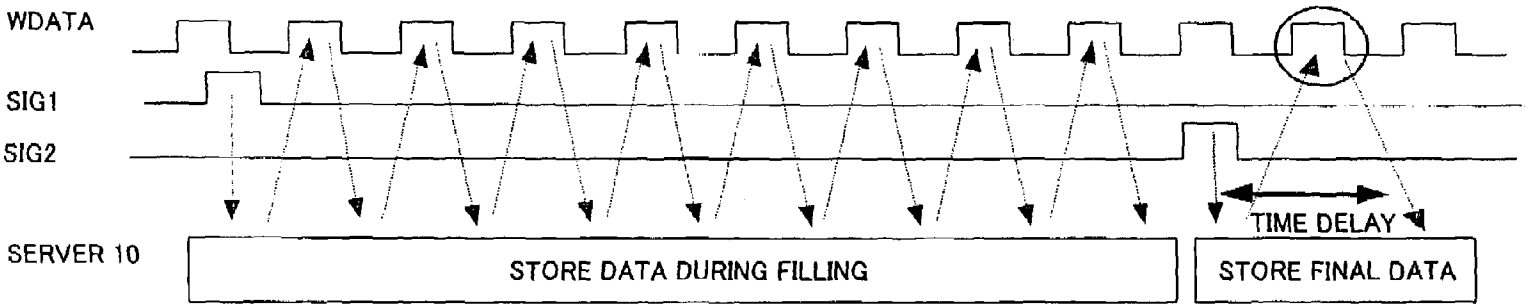
FIGS. 7A and 7B are timing charts of data output from the measurement unit 130 in the toner container filling device 30 and the timing signal output from the controller 140 in the toner production management system 1 according to the third embodiment of the present invention.
Figure 7B:
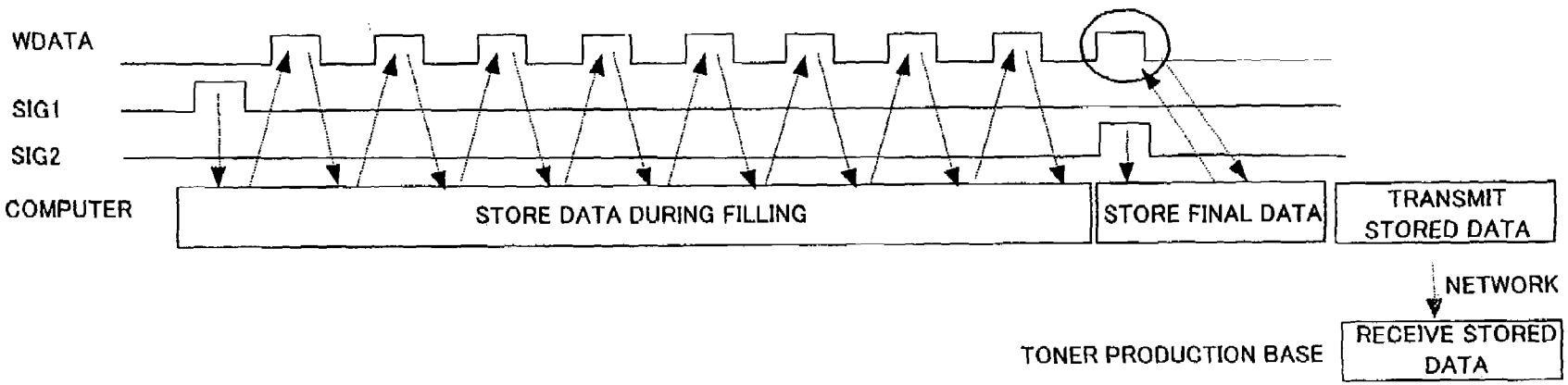

FIGS. 7A and 7B are timing charts of data output from the measurement unit 130 in the toner container filling device 30 and the timing signal output from the controller 140 in the toner production management system 1 according to the third embodiment of the present invention, where FIG. 7A shows the case in which the data are transmitted to the toner production base 2 directly, and FIG. 7B shows the case in which the toner container filling information is stored in the computer 150 for a while before being transmitted to the toner production base 2.

FIG. 7A shows the weight data (WDATA) measured by the measurement unit 130, the toner container filling starting signal (SIG1) and the toner container filling ending signal (SIG2) output from the controller 140, and operations of the toner production base server 10.

In FIG. 7A, the weight data (WDATA) measured by the measurement unit 130 are digitized and output at specified timing intervals. The toner production base server 10 uses the data received from the measurement unit 130 right after the toner container filling starting signal SIG1 is received as the initial weight of the toner bottle 200, and the data received from the measurement unit 130 right after the toner container filling ending signal SIG2 is received as the full weight of the toner bottle 200. From these data, the toner production base server 10 calculates the net weight of the toner pumped into the toner bottle 200. However, because of fluctuations of delay through the network and fluctuations of the CPU processing time in the server 10 affecting the information sent from many toner container filling bases 3, there may arise time delays in the transmitted data, resulting in variations of the obtained net weight of toner.

FIG. 7B shows the weight data (WDATA) measured by the measurement unit 130, the toner container filling starting signal (SIG1) and the toner filling ending signal (SIG2) output from the controller 140, and operations of the computer 150.

In FIG. 7B, the weight data (WDATA) measured by the measurement unit 130 are digitized and output at specified timing intervals. The computer 150 uses the data received from the measurement unit 130 right after the toner container filling starting signal SIG1 is received as the initial weight of the toner bottle 200, and the data received from the measurement unit 130 right after the toner container filling ending signal SIG2 is received as the full weight of the toner bottle 200, and from these data, the computer 150 calculates the net weight of the toner pumped into the toner bottle 200. Here, because there are no fluctuations of delay through the network and no fluctuations of CPU processing time in the server 10 affecting the information sent from many toner container filling bases 3, time delays do not occur in the transmitted data, and variations in the obtained net weight of toner do not occur.

The toner container filling information stored in the computer 150 is transmitted to the toner production base 2 through the network 20.

Figure 8B:
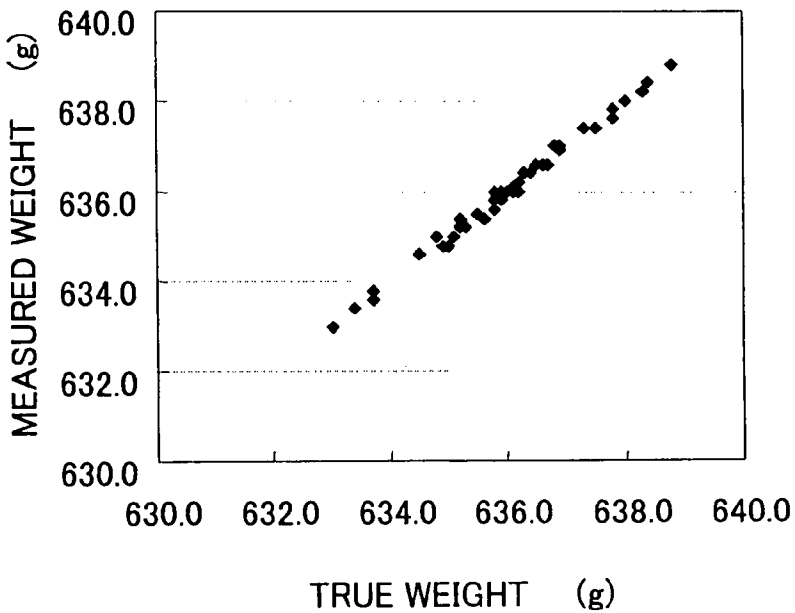
FIGS. 8A and 8B are plots showing fluctuation of the measured amount of pumped toner in the toner production management system according to the third embodiment of the present invention.
Figure 8A:
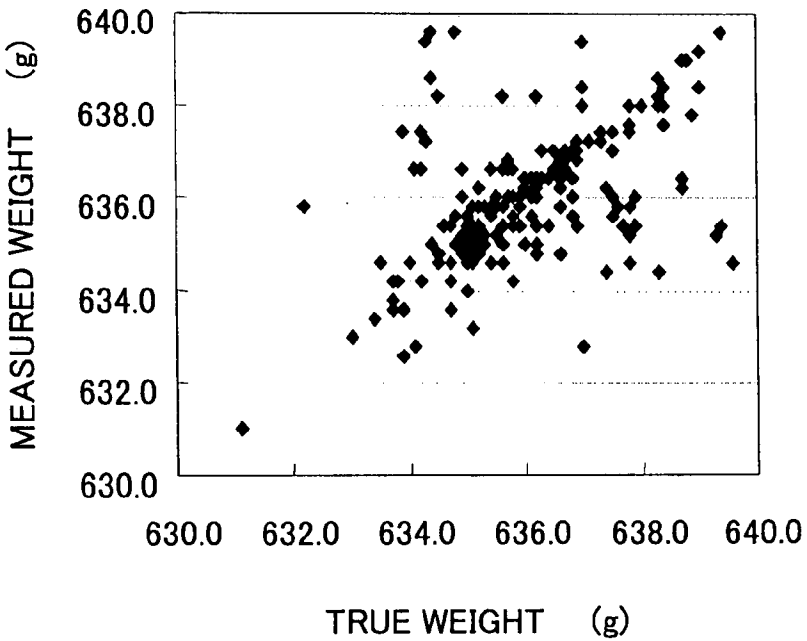

FIGS. 8A and 8B are plots showing the degree of fluctuation of the measured quantity of the pumped toner in the toner production management system 1 according to the third embodiment of the present invention, where FIG. 8A shows the case in which the quantity of the pumped toner is deduced from the data output from the measurement unit 130 and received directly at the toner production base 2, and FIG. 8B shows the case in which the quantity of the pumped toner is deduced from the data output from the measurement unit 130 and received by the computer 150.

In FIG. 8A, the ordinate represents the data output from the measurement unit 130 and received directly by the toner production base server 10, and the abscissa represents the true weight of the toner bottle 200 obtained by the electronic balance. As shown in FIG. 8A, the measured data have large variations.

In FIG. 8B, the ordinate represents the weight data output from the measurement unit 130 and received by the computer 150, and the abscissa represents the true weight of the toner bottle 200 obtained by the electronic balance. As shown in FIG. 8B, the measured data are well correlated with the true weights, and the variation is very small.

As described above, it is possible to collect accurate toner container filling information at the toner production base 2, if storing the data output from the controller 140 and the measurement unit 130 into the computer 150 first to calculate the desired toner container filling information, and then transmitting the toner container filling information from the computer 150 to the toner production base 2 at specified timings.

FIG. 9 is a table showing an example of the data structure of the data received by the server 10 at the toner production base 2 and held in a data base in the toner production management system 1 according to the present embodiment. Specifically, the table in FIG. 9 presents the raw data of the toner container filling information received from the toner container filling bases 3.

The data received from the toner container filling bases 3 are classified into a number of files each containing the toner container filling information of a toner container filling device 3 (denoted as "filler" in FIG. 9) of a specific device number. As illustrated in FIG. 9, each file includes the date, month, and year (D/M/Y) when the toner container filling device fills toner bottles, identification number (ID) of the toner bottler 200, starting time of toner bottle filling, weight of the toner bottle 200 at the starting time, ending time of toner bottle filling, weight of the toner bottler 200 at the ending time, total toner bottle filling time, weight of the pumped toner, temperature inside the toner storage section 100, and the pressure of the compressed air.

In FIG. 9, the data enclosed by the dashed line, that is, the starting time of toner bottle filling, weight of the toner bottle 200 at the starting time, ending time of toner bottle filling, weight of the toner bottle 200 at the ending time, are not necessarily transmitted from the toner container filling bases 3, but if these data are received and stored, it is possible to grasp the operating conditions of the toner container filling device 30 at various time periods, and the change in the amount of the pumped toner. Note that the data structure shown here is just an example; it is not necessary to limit the data structure to this.

FIG. 10 is a table showing another example of a data structure of the data received by the server 10 provided at the toner production base and held in a data base in the toner production management system 1 according to the present embodiment. Specifically, the table in FIG. 10 presents the data obtained by processing the raw data received from the toner container filling bases 3 to show the overall condition of the toner production base 2.

As shown in FIG. 10, in order to process the raw data classified into files according to the numbers of the toner container filling bases 3 into data for showing the overall condition of the toner production base 2, the data are sorted according to the toner container filling bases 3, and the data of a toner container filling base includes the date, month, and year (D/M/Y) when the toner container filling device pumps toner, the total number of the toner container filling devices installed in the toner filling base 3, the number of the toner container filling devices in operation, the information of individual toner container filling devices installed in the toner filling base containing the number of toner bottles that have been filled by the device, the accumulated weight of the pumped toner, the accumulated filling time, the total number of toner bottles that have been filled at the toner container filling base, the total weight of the pumped toner at the toner container filling base, the total filling time at the toner container filling base, the total number, and the specific identification numbers of the toner container filling devices with problems at the toner container filling base.

Here, for example, whether a toner container filling device 30 is in trouble or not is determined by the toner container filling time for a toner bottle 200, the temperature in the toner storage section 100, and the pressure of the compressed air.

Figure 11:
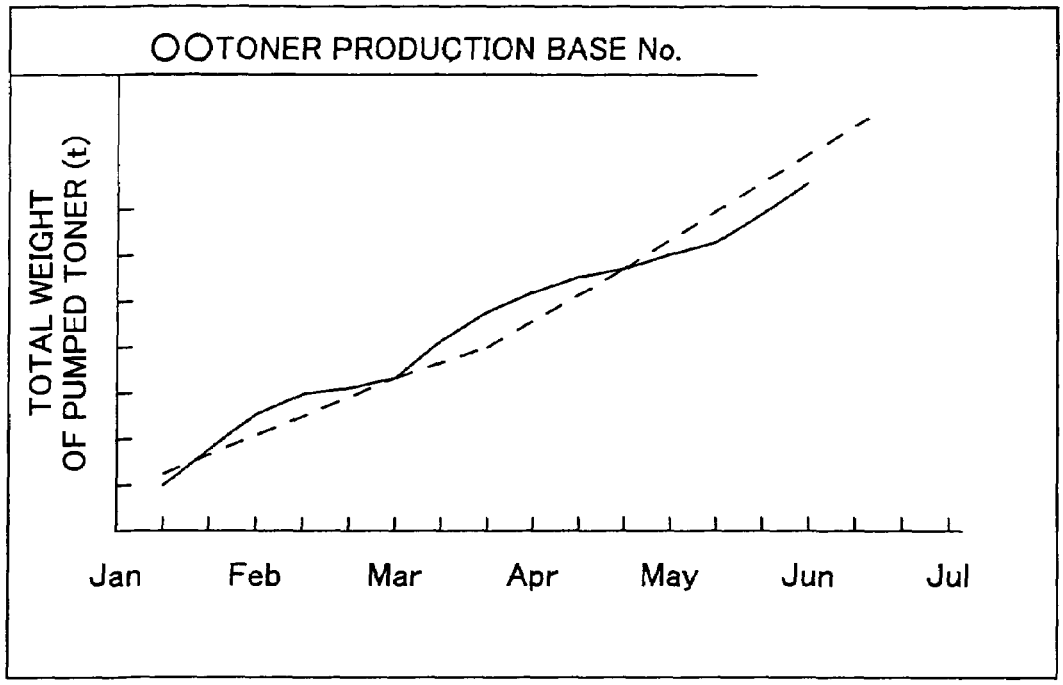
FIG. 11 is a graph showing an example of the change of the amount of the pumped toner displayed on a monitor screen of the server provided at the toner production base in the toner production management system according to the third embodiment of the present invention.

FIG. 11 is a graph showing an example of the change of the amount of the pumped toner displayed on a monitor screen of the server 10 at the toner production base 2 in the toner production management system 1 according to the present embodiment. In FIG. 11, the abscissa indicates month, and the ordinate indicates the weight of the pumped toner.

As illustrated in FIG. 11, summing the processed data, which are classified into files corresponding to the toner container filling bases at the toner production base 2, respectively, every day, every week, and every month, as shown in FIG. 10, then the change of the total amount of the pumped toner at the toner production base 2 can be shown by the solid line in FIG. 11. Further, for example, the production plan of the amount of toner can be shown by the dashed line.

In addition to representing the change of the total amount of the pumped toner at the toner production base 2, the change of the total amount of the pumped toner at individual toner container filling bases 3 may also be displayed together, or separately. Further, the change of the total amount of the pumped toner in different time periods may also be displayed. The data displayed on the screen may also be edited and printed out on paper.

The collected toner container filling information as described above may be used for drawing the plan of toner production and toner delivery from the toner production base 2 to the toner container filling bases 3. Further, making the bottle identification number in correspondence with customer numbers, it is possible to further perform payment processing together with the toner container filling process.

Figure 12:
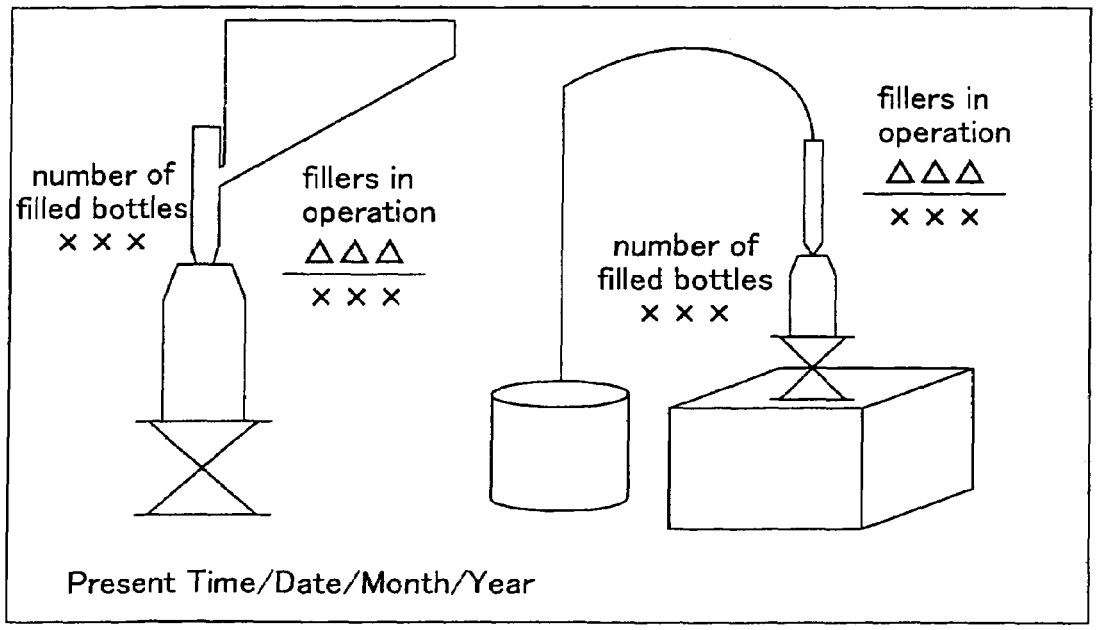
FIG. 12 is a view showing an example of the operation condition of the toner container filling devices 30 displayed on a monitor screen of the server 10 at the toner production base 2 in the toner production management system 1 according to the third embodiment of the present invention.

FIG. 12 is a view showing an example of the operation condition of the toner container filling devices 30 displayed on a monitor screen of the server 10 at the toner production base 2 in the toner production management system 1 according to the present embodiment.

As illustrated in FIG. 12, summing the processed data, which are classified into files corresponding to the toner container filling bases at the toner production base 2, respectively, every day, every week, and every month, as shown in FIG. 10, the number of the toner container filling devices in operation, and the operation rate, the number of the toner bottles that have been filled, and so on, can be displayed on the screen.

In addition to displaying the overall operational condition of the toner production base 2, the condition of the individual toner container filling bases 3 may also be displayed, further, the toner container filling devices 30 may be displayed according to their types.

Fourth Embodiment

Figure 13:
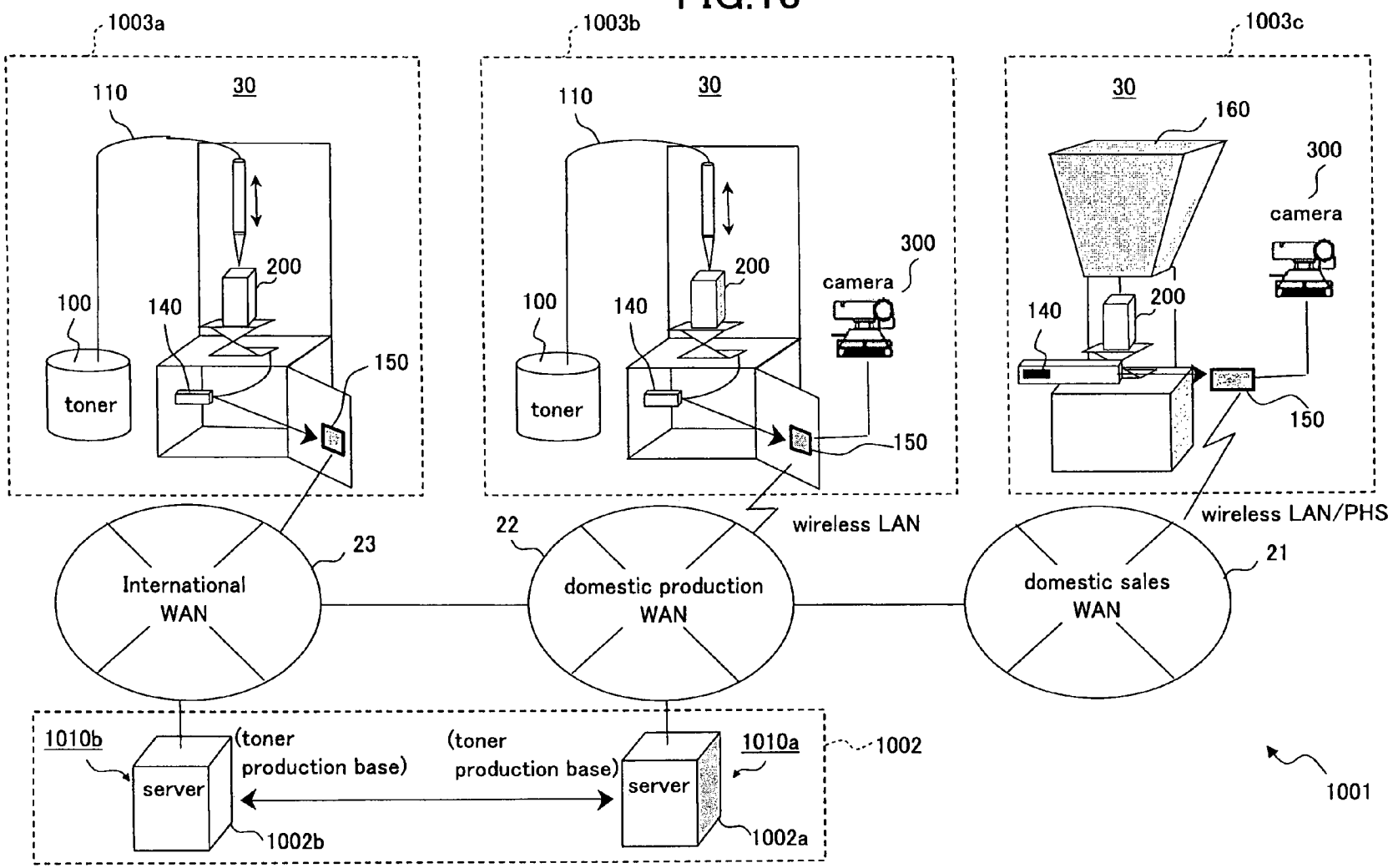
FIG. 13 is a schematic view of a configuration of a toner production management system according to a fourth embodiment of the present invention.

FIG. 13 is a schematic view of a configuration of a toner production management system 1001 according to a fourth embodiment of the present invention.

The toner production management system 1001 of the present embodiment is basically the same as that described in the third embodiment, except that in the toner production management system 1001, a toner production-base 1002 includes a factory 1002*a* and a supply base 1002*b* where a large amount of toner transported from the factory is stocked, and in a toner filling base 1003, a camera 300 is installed to facilitate monitoring the toner container filling process, especially the condition of the toner container filling devices 30. Below, the overlapping descriptions are omitted.

As illustrated in FIG. 13, in the toner production management system 1001, the toner production base 1002 includes a factory 1002*a* that produces toner and a supply base 1002*b* located in a foreign country (referred to as "overseas supply base"), where a large amount of toner produced at the factory 1002*a* is transported and stocked.

The factory 1002*a* is connected to a domestic production network 22 that connects a number of toner container filling bases 1003*b* each including one or more toner container filling devices 30 as shown in FIGS. 1 through 3 (only one toner container filling base 1003*b* is shown in FIG. 13 for simplicity), and a domestic sales network 21 that connects a number of toner container filling bases 1003*c* each including one or more toner container filling devices 30 as shown in FIG. 4 (only one toner container filling base 1003*c* is shown in FIG. 13 for simplicity).

The server 1010*a* installed at the factory 1002*a* collects toner container filling information of the toner container filling bases 1003, to whom the factory 1002*a* supplies toner, through the networks 21 and 22.

In the above, it is described that the toner container filling devices 30 and the domestic sales network 21 are connected to each other by a wireless LAN or PHS (Personal Handyphone System), and the toner container filling devices 30 and the domestic production network 22 are connected to each other by a wireless LAN, but these are just examples, and the invention is not limited to these.

In each of the toner container filling base 1003*b* and toner container filling base 1003*c*, which are connected to the domestic sales network 21 and the domestic production network 22, a camera 300 is installed. Since the cameras 300 are connected to the domestic sales network 21 and the domestic production network 22 through the computer 150, video signals of images captured by the cameras 300 are sent to the server 1010*a* at the factory 1002*a*, and are displayed on a monitor screen.

The overseas supply base 1002*b* is connected to an international network 23 that connects a number of toner container filling bases 1003*a* each including one or more toner container filling devices 30 as shown in FIGS. 1 through 3 (only one toner container filling base 1003*a* is shown in FIG. 13 for simplicity). The server 1010*b* installed at the overseas supply base 1002*b* collects toner container filling information of the toner filling bases 1003, to whom the overseas supply base 1002*b* supplies toner, through the international network 23.

The toner pumping information collected at the toner production base 1002 including the factory 1002*a* or the overseas supply base 1002*b* can be displayed as is described in FIG. 11. For example, the change of the total amount of the pumped toner at the toner production base 1002 may be displayed together with the graph showing the plan of toner production; or the change of the total amount of the pumped toner at individual toner container filling bases 1003 may be displayed together, or separately. Further, the change of the total amount of the pumped toner in different time periods may be displayed.

In addition, the operational condition, such as the number of the toner container filling devices 30 in operation, or the operation rate, or the number of the toner bottles that have been filled with toner can be displayed on the screen according to the types of the toner container filling devices 30, or for each toner container filling base 1003. Furthermore, the data displayed on the screen may also be edited and printed out on paper.

The toner container filling information collected from the toner container filling bases 1003 as described above may be used for drawing the plan of toner production and toner delivery from the toner production base 1002 to the toner container filling bases 10033. Further, by correlating the bottle identification numbers with customer numbers, it is possible to further perform payment processing together with the toner container filling process.

Moreover, since the server 1010*a* installed at the factory 1002*a* and the server 1010*b* installed at the overseas supply base 1002*b* are connected to each other via a network, one server may read the data managed by the other server, and display the data in its own monitor screen, or print the data using a printer.

Further, since the cameral 300 sends video signals of the toner container filling process and the condition of the toner container filling devices 30 to the server 1010*a* at the factory 1002*a*, and these video signals are displayed on a monitor screen, it is possible to determine which toner container filling devices are at low operation rates, and which toner container filling devices are falling into trouble from the monitor screen, and to direct the taking of appropriate actions.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

Summarizing the effect of the invention, according to the toner container filling device of the present invention, because a toner fluid bed is formed in a toner storage section, toner can be ejected from a nozzle smoothly. Since the filling process stops automatically when a toner bottle is fully filled, the toner container filling process can be performed efficiently.

According to toner production management system of the present invention, since toner container filling information is automatically sent from a computer of a toner container filling device at a toner container filling base to a server at a toner production base, and the information collected at the toner production base may be displayed or processed for drawing up a toner production plan and toner delivery plan, it is possible to supply toner without running out of stock.

This patent application is based on Japanese priority patent applications No. 2002-197223 filed on Jul. 5, 2002 and No. 2003-145409 filed on Mar. 22, 2003, the entire contents of which are hereby incorporated by reference.

What is claimed is:

1. A toner production management system for managing production of toner at a toner production base and delivery of the toner from the toner production base to a toner container filling base where the toner is pumped into a toner container, the toner production management system comprising:

a toner container filling device provided at the toner container filling base for filling the toner container with the toner delivered from the toner production base; the toner container filling device, while pumping toner into the toner container, measuring toner container filling data and transmitting the toner container filling data; and a server configured to receive the toner container filling data and determine the amount of toner production at the toner production base and the time of toner delivery from the toner production base to the toner container filling base based on the toner container filling data.

2. The toner production management system as claimed in claim 1, wherein the toner container filling device comprises:

a toner storage section configured to store the toner; a toner container filling section configured to take in toner from the toner storage section and pump the toner into the toner container;

a measurement unit configured to measure the weight of the toner container and output weight data of the toner container; and a control section configured to calculate the weight of the toner pumped into the toner container using the weight data of the toner container output from the measurement unit and transmit the weight of the pumped toner to the server as one element of the toner container filling data, the control section controlling the toner container filling section to start pumping the toner into the toner container when the toner container is empty, and stop the toner container filling section from pumping the toner into the toner container when the toner container is fully filled with toner.

3. The toner production management system as claimed in claim 2, wherein the control section includes a switch unit configured to start and stop toner ejection from the toner container filling section and the switch unit transmits a start signal and a stop signal, respectively; and the control section calculates a toner container filling time from the timings of the start signal and the stop signal and transmits the toner container filling time to the server as another element of the toner container filling data.

4. The toner production management system as claimed in claim 1, wherein the server includes a display unit configured to display the toner container filling data transmitted from the toner container filling device.

5. The toner production management system as claimed in claim 1, further comprises an image capturing unit configured to capture an image of a condition of the toner container filling device and output video signals of the image to the server.

* * * * *